US012571546B2

(12) United States Patent
Meles et al.

(10) Patent No.: US 12,571,546 B2
(45) Date of Patent: Mar. 10, 2026

(54) LIQUID DESICCANT AIR CONDITIONING USING AIR AS HEAT TRANSFER MEDIUM

(71) Applicant: Mojave Energy Systems, Inc., Palo Alto, CA (US)

(72) Inventors: Aaron Meles, Grand Rapids, MI (US); Rachel Ellman, Palo Alto, CA (US); Chris Savarino, Rancho Cordova, CA (US)

(73) Assignee: Mojave Energy Systems, Inc., Sunnyvale, CA (US)

( * ) Notice: Subject to any disclaimer, the term of this patent is extended or adjusted under 35 U.S.C. 154(b) by 0 days.

(21) Appl. No.: 17/719,598

(22) Filed: Apr. 13, 2022

(65) Prior Publication Data

US 2023/0332780 A1 Oct. 19, 2023

(51) Int. Cl.
*F24F 3/14* (2006.01)
*F24F 3/153* (2006.01)

(52) U.S. Cl.
CPC ..... *F24F 3/1417* (2013.01); *F24F 3/153* (2013.01); *F24F 2003/1452* (2013.01); *F24F 2003/1458* (2013.01)

(58) Field of Classification Search
CPC .. F24F 3/1417; F24F 3/153; F24F 2003/1452; F24F 2003/1458; F24F 5/0014; F24F 2203/026
See application file for complete search history.

(56) References Cited

U.S. PATENT DOCUMENTS

| | | | |
|---|---|---|---|
| 2,147,248 | A | 2/1939 | Fleisher |
| 2,214,880 | A | 9/1940 | Crawford |
| 2,276,970 | A | 3/1942 | Hyde |
| 2,290,465 | A | 7/1942 | Crawford |
| 2,672,024 | A | 3/1954 | Mcgrath |
| 2,798,570 | A | 7/1957 | Kelley |

(Continued)

FOREIGN PATENT DOCUMENTS

| | | | |
|---|---|---|---|
| CN | 103288252 | A | 9/2013 |
| CN | 105308317 | A | 2/2016 |

(Continued)

OTHER PUBLICATIONS

WO-9528609-A1 Translation (Year: 1995).*

(Continued)

*Primary Examiner* — David J Teitelbaum

(57) ABSTRACT

A liquid desiccant system includes a liquid desiccant loop having an absorber unit in fluid communication with a desorber unit and liquid desiccant flowing between the absorber unit and the desorber unit. The liquid desiccant system includes a supply airflow path passing through the absorber unit and forming an absorber liquid/air interface within the absorber unit and a conditioned airflow exiting the absorber unit. The liquid desiccant system includes a regeneration airflow path passing through the desorber unit and forming a desorber liquid/air interface within the desorber unit and an exhaust airflow exiting the desorber unit. A heat exchanger is thermally coupled to the supply airflow path for removing heat from supply airflow upstream of the absorber unit. A heat exchanger is thermally coupled to the regeneration airflow path adding heat to regeneration airflow upstream of the desorber unit.

47 Claims, 2 Drawing Sheets

(56) References Cited

U.S. PATENT DOCUMENTS 3,277,954 A 10/1966 Gershon
3,336,423 A 8/1967 Le et al.
3,350,892 A 11/1967 Kelley
3,729,142 A 4/1973 Rangel et al.
3,819,118 A 6/1974 Brock et al.
3,981,452 A 9/1976 Eckstein
3,993,248 A 11/1976 Harmony
4,118,299 A 10/1978 Maget
4,164,125 A 8/1979 Griffiths
4,180,985 A 1/1980 Northrup, Jr.
4,205,529 A 6/1980 Ko
4,259,849 A 4/1981 Griffiths
4,287,721 A 9/1981 Robison
4,340,479 A 7/1982 Pall
4,340,480 A 7/1982 Pall et al.
4,355,683 A 10/1982 Griffiths
4,593,534 A 6/1986 Bloomfield
4,612,019 A 9/1986 Langhorst
4,691,530 A 9/1987 Meckler
4,700,550 A * 10/1987 Rhodes ..... F24F 3/147 62/271
4,887,438 A 12/1989 Meckler
4,900,448 A 2/1990 Bonne et al.
4,905,479 A 3/1990 Wilkinson
4,955,205 A 9/1990 Wilkinson
4,984,434 A 1/1991 Peterson et al.
5,022,241 A 6/1991 Wilkinson
5,058,394 A 10/1991 Wilkinson
5,070,703 A 12/1991 Wilkinson
5,191,771 A 3/1993 Meckler
5,351,497 A 10/1994 Lowenstein
5,460,004 A 10/1995 Tsimerman
5,528,905 A 6/1996 Scarlatti
5,586,727 A 12/1996 Shekalim
5,615,838 A 4/1997 Eckstein et al.
5,634,269 A 6/1997 Lowenstein et al.
5,797,272 A 8/1998 James
5,928,409 A 7/1999 Sirkar
5,966,955 A 10/1999 Maeda
6,018,954 A 2/2000 Assaf
6,080,507 A 6/2000 Yu
6,149,817 A 11/2000 Peterson et al.
6,159,352 A 12/2000 Riera et al.
6,187,201 B1 2/2001 Abe et al.
6,463,750 B2 10/2002 Assaf
6,487,872 B1 12/2002 Forkosh et al.
6,497,107 B2 12/2002 Maisotsenko et al.
6,497,749 B2 12/2002 Kesten et al.
6,719,891 B2 4/2004 Ruhr et al.
6,745,826 B2 6/2004 Lowenstein et al.
6,945,065 B2 9/2005 Lee et al.
6,976,365 B2 12/2005 Forkosh et al.
6,986,428 B2 1/2006 Hester et al.
7,083,730 B2 8/2006 Davis
7,279,215 B2 10/2007 Hester et al.
7,360,375 B2 4/2008 Mola et al.
7,430,878 B2 10/2008 Assaf
7,942,011 B2 5/2011 Forkosh
7,942,387 B2 5/2011 Forkosh
7,974,076 B2 7/2011 Xiong et al.
7,977,395 B2 7/2011 Lin et al.
7,992,855 B2 8/2011 Awano
8,047,511 B2 11/2011 Miyauchi et al.
8,142,633 B2 3/2012 Batchelder et al.
8,171,746 B2 5/2012 Miyauchi et al.
8,545,692 B2 10/2013 James et al.
8,623,210 B2 1/2014 Manabe et al.
8,685,142 B2 4/2014 Claridge et al.
8,696,805 B2 4/2014 Chang et al.
8,769,971 B2 7/2014 Kozubal et al.
8,769,972 B2 7/2014 Bahar
8,790,454 B2 7/2014 Lee et al.
8,800,308 B2 8/2014 Vandermeulen et al.
8,801,910 B2 8/2014 Bazant et al.
8,943,844 B2 2/2015 Forkosh
8,999,132 B2 4/2015 Bazant et al.
9,000,289 B2 4/2015 Vandermeulen et al.
9,086,223 B2 7/2015 Vandermeulen et al.
9,101,874 B2 8/2015 Vandermeulen
9,101,875 B2 8/2015 Vandermeulen et al.
9,112,217 B2 8/2015 Kim et al.
9,140,471 B2 9/2015 Kozubal et al.
9,243,810 B2 1/2016 Vandermeulen et al.
9,267,696 B2 2/2016 Gerlach et al.
9,273,876 B2 3/2016 Smith et al.
9,308,490 B2 4/2016 Vandermeulen et al.
9,340,436 B2 5/2016 Sahu et al.
9,506,697 B2 11/2016 Vandermeulen
9,541,302 B2 1/2017 Taylor et al.
9,546,426 B2 1/2017 Logan et al.
9,548,620 B2 1/2017 Hu et al.
9,631,824 B1 4/2017 Maisey et al.
9,631,848 B2 4/2017 Vandermeulen et al.
9,640,826 B2 5/2017 Yan et al.
9,670,077 B2 6/2017 Volkel et al.
9,673,472 B2 6/2017 Volkel et al.
9,709,285 B2 7/2017 Vandermeulen
9,835,340 B2 12/2017 Vandermeulen et al.
9,905,876 B2 2/2018 Schubert et al.
9,982,901 B2 5/2018 Mongar
10,012,401 B2 7/2018 Forkosh
10,024,558 B2 7/2018 Vandermeulen
10,124,296 B2 11/2018 Pozzo et al.
10,302,317 B2 5/2019 Erb et al.
10,443,868 B2 10/2019 Vandermeulen et al.
10,525,417 B2 1/2020 Newbloom et al.
10,550,014 B2 2/2020 Desai et al.
10,604,426 B2 3/2020 Connor, Jr. et al.
10,648,743 B2 5/2020 Kozubal et al.
10,655,870 B2 5/2020 Lowenstein
10,712,024 B2 7/2020 LePoudre et al.
10,721,024 B2 7/2020 Seo
10,821,395 B2 11/2020 Beh et al.
10,822,254 B2 11/2020 Desai et al.
10,962,252 B2 3/2021 LePoudre et al.
11,015,875 B2 5/2021 Benedict et al.
11,020,713 B2 6/2021 Demeter et al.
11,029,045 B2 6/2021 Woods et al.
11,117,090 B2 9/2021 Benedict et al.
11,149,970 B2 10/2021 Bahar et al.
11,185,823 B2 11/2021 Beh et al.
11,326,790 B2 5/2022 Woods et al.
11,532,831 B1 12/2022 Beh
11,760,631 B2 9/2023 Chandran et al.
11,944,934 B2 4/2024 Benedict et al.
11,998,871 B2 6/2024 Benedict et al.
12,050,022 B2 7/2024 Ellman et al.
12,085,293 B2 9/2024 Benedict et al.
12,276,436 B2 4/2025 Farese et al.
2002/0038552 A1 4/2002 Maisotsenko et al.
2003/0121271 A1 7/2003 Dinnage et al.
2004/0118125 A1 6/2004 Potnis et al.
2004/0168462 A1 9/2004 Assaf
2004/0231512 A1* 11/2004 Slayzak ..... B01D 53/28 96/290
2005/0183956 A1 8/2005 Katefidis
2006/0130654 A1* 6/2006 King ..... B01D 5/0045 95/231
2006/0141346 A1 6/2006 Gordon et al.
2008/0135495 A1 6/2008 Sher
2009/0095162 A1 4/2009 Hargis et al.
2009/0114594 A1 5/2009 Sirkar
2009/0178436 A1* 7/2009 Chiriac ..... G06F 1/20 62/515
2010/0090356 A1 4/2010 Sines et al.
2010/0170776 A1 7/2010 Ehrenberg et al.
2010/0275629 A1 11/2010 Erickson
2011/0132027 A1* 6/2011 Gommed ..... F28D 21/0015 62/477
2012/0125020 A1 5/2012 Vandermeulen et al.
2012/0304862 A1 12/2012 Taylor et al.
2013/0056177 A1* 3/2013 Coutu ..... F24F 12/002 165/104.11
2013/0118478 A1 5/2013 Armstrong et al.

(56) References Cited

U.S. PATENT DOCUMENTS

| | | | | |
|---|---|---|---|---|
| 2013/0199220 | A1 | 8/2013 | Ma et al. | |
| 2013/0227982 | A1 | 9/2013 | Forkosh | |
| 2013/0319021 | A1* | 12/2013 | Ball | B01D 53/263 62/93 |
| 2013/0340449 | A1 | 12/2013 | Kozubal et al. | |
| 2014/0054013 | A1 | 2/2014 | LePoudre et al. | |
| 2014/0260367 | A1* | 9/2014 | Coutu | F24F 12/002 62/271 |
| 2014/0262125 | A1 | 9/2014 | Erb et al. | |
| 2014/0326433 | A1 | 11/2014 | Kozubal | |
| 2014/0349279 | A1 | 11/2014 | Berthelot et al. | |
| 2015/0048777 | A1 | 2/2015 | Goldstein | |
| 2015/0059576 | A1 | 3/2015 | Shibata | |
| 2015/0068225 | A1 | 3/2015 | Laughman et al. | |
| 2015/0101625 | A1 | 4/2015 | Newton et al. | |
| 2015/0232348 | A1 | 8/2015 | Jepson | |
| 2015/0260420 | A1 | 9/2015 | Forkosh | |
| 2015/0291452 | A1 | 10/2015 | Jikihara et al. | |
| 2015/0292754 | A1 | 10/2015 | Mongar | |
| 2015/0300754 | A1 | 10/2015 | Vandermeulen et al. | |
| 2015/0327596 | A1 | 11/2015 | Alarcon et al. | |
| 2015/0338140 | A1* | 11/2015 | Vandermeulen | F24F 3/1417 62/238.3 |
| 2016/0138817 | A1 | 5/2016 | Hamlin et al. | |
| 2017/0145803 | A1 | 5/2017 | Yeh et al. | |
| 2017/0241654 | A1 | 8/2017 | Lowenstein | |
| 2017/0292722 | A1 | 10/2017 | Vandermeulen | |
| 2017/0370598 | A1 | 12/2017 | Hamlin et al. | |
| 2018/0036675 | A1 | 2/2018 | Antony Prince et al. | |
| 2018/0187906 | A1 | 7/2018 | Bahar et al. | |
| 2018/0191012 | A1 | 7/2018 | Zhang et al. | |
| 2018/0328602 | A1 | 11/2018 | Vandermeulen | |
| 2019/0145639 | A1* | 5/2019 | Allen | F28F 27/00 62/94 |
| 2019/0240614 | A1 | 8/2019 | Beh et al. | |
| 2019/0240623 | A1 | 8/2019 | Beh et al. | |
| 2019/0285290 | A1* | 9/2019 | Woods | F24F 3/1417 |
| 2019/0331353 | A1 | 10/2019 | Edström et al. | |
| 2020/0039314 | A1 | 2/2020 | Minakuchi et al. | |
| 2020/0063995 | A1 | 2/2020 | LePoudre | |
| 2020/0070094 | A1 | 3/2020 | Hussaini et al. | |
| 2020/0096212 | A1 | 3/2020 | LePoudre | |
| 2020/0164302 | A1 | 5/2020 | Benedict et al. | |
| 2020/0164312 | A1 | 5/2020 | Beh et al. | |
| 2020/0173671 | A1 | 6/2020 | Rowe et al. | |
| 2020/0182493 | A1 | 6/2020 | Luttik | |
| 2020/0278126 | A1 | 9/2020 | Ide et al. | |
| 2020/0326106 | A1 | 10/2020 | Muthusubramanian | |
| 2020/0333086 | A1 | 10/2020 | Benedict et al. | |
| 2020/0346164 | A1 | 11/2020 | Verplancke | |
| 2020/0384421 | A1 | 12/2020 | Newbloom et al. | |
| 2020/0388871 | A1 | 12/2020 | Newbloom et al. | |
| 2020/0393145 | A1 | 12/2020 | Woods et al. | |
| 2021/0254844 | A1 | 8/2021 | Qasem et al. | |
| 2021/0283528 | A1 | 9/2021 | Pokorný et al. | |
| 2021/0298246 | A1 | 9/2021 | Lefers et al. | |
| 2021/0354089 | A1 | 11/2021 | Wu et al. | |
| 2021/0370228 | A1 | 12/2021 | Benedict et al. | |
| 2022/0193612 | A1 | 6/2022 | Torres et al. | |
| 2022/0223885 | A1 | 7/2022 | Beh et al. | |
| 2022/0243932 | A1 | 8/2022 | Benedict et al. | |
| 2022/0299223 | A1 | 9/2022 | Benedict et al. | |
| 2022/0410070 | A1 | 12/2022 | Beh | |
| 2023/0141446 | A1 | 5/2023 | Beh et al. | |
| 2023/0173433 | A1 | 6/2023 | Benedict et al. | |
| 2023/0191312 | A1 | 6/2023 | Benedict et al. | |
| 2023/0264140 | A1 | 8/2023 | Beh et al. | |
| 2023/0280049 | A1 | 9/2023 | Farese et al. | |
| 2023/0294038 | A1 | 9/2023 | Wallace | |
| 2024/0131468 | A1 | 4/2024 | Morajkar | |
| 2024/0337393 | A1 | 10/2024 | Farese et al. | |
| 2025/0090994 | A1 | 3/2025 | Michael et al. | |
| 2025/0129950 | A1 | 4/2025 | Ellman et al. | |
| 2025/0180235 | A1 | 6/2025 | Benedict et al. | |
| 2025/0216098 | A1 | 7/2025 | Farese et al. | |

FOREIGN PATENT DOCUMENTS

| | | | | |
|---|---|---|---|---|
| CN | 206055832 | U | 3/2017 | |
| CN | 206291383 | U | 6/2017 | |
| CN | 108187459 | A | 6/2018 | |
| CN | 207455783 | U | 6/2018 | |
| CN | 207501630 | U | 6/2018 | |
| CN | 111964168 | A | 11/2020 | |
| EP | 3060856 | A1 | 8/2016 | |
| EP | 3336064 | A1 | 6/2018 | |
| EP | 4063001 | A1 | 9/2022 | |
| JP | H0418919 | A | 1/1992 | |
| JP | H05245346 | A | 9/1993 | |
| JP | 2001174074 | A * | 6/2001 | F24F 3/1423 |
| JP | 2009544131 | A | 12/2009 | |
| JP | 2010276317 | A | 12/2010 | |
| JP | 2019141835 | A | 8/2019 | |
| KR | 20110080893 | A | 7/2011 | |
| KR | 20130106530 | A | 9/2013 | |
| KR | 20140046913 | A | 4/2014 | |
| KR | 20150034545 | A | 4/2015 | |
| KR | 20170030129 | A | 3/2017 | |
| WO | WO-9528609 | A1 * | 10/1995 | F24F 12/003 |
| WO | WO-2008078194 | A2 | 7/2008 | |
| WO | WO-2011062808 | A1 | 5/2011 | |
| WO | WO-2012170887 | A2 | 12/2012 | |
| WO | WO-2014181898 | A1 | 11/2014 | |
| WO | WO-2015143332 | A2 | 9/2015 | |
| WO | WO-2017189850 | A1 | 11/2017 | |
| WO | WO-2018032003 | A1 | 2/2018 | |
| WO | WO-2018119280 | A1 | 6/2018 | |
| WO | WO-2018191806 | A1 | 10/2018 | |
| WO | WO-2019089971 | A1 | 5/2019 | |
| WO | WO-2020112592 | A1 | 6/2020 | |
| WO | WO-2020112712 | A1 | 6/2020 | |
| WO | WO-2023122749 | A2 | 6/2023 | |
| WO | WO-2023201184 | A1 | 10/2023 | |
| WO | WO-2024086450 | A1 | 4/2024 | |
| WO | WO-2024211820 | A2 | 10/2024 | |

OTHER PUBLICATIONS

JP-2001174074-A Translation.*

Gao et al., "A review on integration and design of desiccant air-conditioning systems for overall performance improvements," Renewable and Sustainable Energy Reviews, Feb. 23, 2021; 141:110809: 25 pgs.

Zhang et al., "Performance optimization of heat pump driven liquid desiccant dehumidification systems," Energy and Buildings, Jun. 9, 2012;52:132-144.

Abdollahi and Shams, "Optimization of shape and angle of attack of winglet vortex generator in a rectangular channel for heat transfer enhancement," Applied Thermal Engineering, 2015; 81:376-387.

Al-Jubainawi et al., "Factors governing mass transfer during membrane electrodialysis regeneration of LiCl solution for liquid desiccant dehumidification systems", Sustainable Cities and Society, (Aug. 26, 2016); 28:30-41.

Al-Karaghouli et al., "Energy consumption and water production cost of conventional and renewable-energy-powered desalination processes", Renewable and Sustainable Energy Reviews 2013, 24, 343-356.

Anderson et al., "Capacitive deionization as an electrochemical means of saving energy and delivering clean water. Comparison to present desalination practices: Will it compete?", Electrochimica Acta 2010, 55 (12), 3845-3856.

Arellano et al., "Effects of pH on the degradation of aqueous ferricyanide by photolysis and photocatalysis under Solar radiation", Solar Energy Materials and Solar Cells 2010, 94 (2), 327-332.

Ashrae, et al., "Desiccant Dehumidification and Pressure Drying Equipment," 2012 ASHRAE Handbook—HVAC Systems and Equipment, Chapter 24, pp. 24.1-24.12.

Ashrae Standard, "Method of Testing for Rating Desiccant Dehumidifiers Utilizing Heat for the Regeneration Process", (2007); 4 pages.

(56) References Cited

OTHER PUBLICATIONS

Bajpayee et al., "Very low temperature membrane-free desalination by directional solvent extraction", Energy Environ. Sci. 2011,4 (5), pp. 1672-1675.
Beh et al., "A Neutral pH Aqueous Organic-Organometallic Redox Flow Battery with Extremely High Capacity Retention" ACS Energy Lett, 2017, vol. 2, pp. 639-644.
Biswas and Chattopadhyay, Heat Transfer in a Channel with Built-In Wing-Type Vortex Generators, Int J Heat Mass Transfer, 1992; 35(4):803-814.
Biswas et al., "Numerical and experimental determination of flow structure and heat transfer effects of longitudinal vortices in a channel flow," Int J Heat Mass Transfer, 1996; 39(16):3441-3451.
Btmap-Vi et al., "Ordering and Customer Service Neutral pH Aqueous Redox Flow Battery Materials", Jan. 1, 2017, pp. 639.
Chen et al., "Experimental and numerical heat transfer investigation of an impingement jet array with V-ribs on the target plate and on the impingement plate," Intl J Heat Fluid Flow, 2017;68:126-138.
Cheng et al., "Double-Stage Photovoltaic/Thermal ED Regeneration for Liquid Desiccant Cooling System", Energy and Buildings, 51, 2012, pp. 64-72.
Cheng et al., "Experimental investigation of an electrodialysis regenerator for liquid desiccant", Energy and Buildings, (2013); 67:419-425.
Cheng et al, "Performance analysis of a new desiccant pre-treatment electrodialysis regeneration system for liquid desiccant", 2013, Elsevier, 66, 1-15 (Year: 2013).
Conde-Petit and Weber, "Open Absorption System for Cooling and Air Conditioning using Membrane Contactors—Annual Report 2006," Publication No. 260098, Project: 101310-0pen Absorption System for Cooling and Air Conditioning using Membrane Contactors, Date of publication: Nov. 14, 2006, Contractor: M. Conde Engineering, 13 pages.
Conde-Petit and Weber, "Open Absorption System for Cooling and Air Conditioning Using Membrane Contactors—Final Report," Publication No. 280139, Project: 101310-0pen Absorption System for Cooling and Air conditioning using Membrane Contactors, Date of publication: Jul. 8, 2008, Contractor: M. Conde Engineering. 50 pages.
Conde-Petit, M. "Liquid Desiccant-Based Air-Conditioning Systems—LDACS," Proc. of the 1st European Conference on Polygeneration-Technologies and Applications, 217-234, A. Coronas, ed., Tarragona-Spain, Oct. 16-17, 2007 Published by CREVER-Universitat, 17 pages.
Conde-Petit, M. Open Absorption Systems for Air-Conditioning using Membrane Contactors, Proceedings '15. Schweizerisches Status-Seminar Energie-und Umweltforschung im Bauwesen', Sep. 11-12, 2008—ETH Zurich, Switzerland. Published by BRENET-Eggwilstr. 16a, CH-9552 Bronschhofen-Switzerland (brenet@vogel-tech.ch), 12 pages.
Conde-Petit, Manuel, "Open Absorption System for Cooling and Air Conditioning using Membrane Contactors—Annual Report 2005," Publication No. Publication 260097, Project: 101310-0pen Absorption System for Cooling and Air conditioning using Membrane Contactors, Date of publication: Jan. 31, 2006, Contractor: M. Conde Engineering, 8 pages.
"Cooling tower Fill material: Gain a Deep Understanding," Linquip Technews, available online [retrieved on Mar. 1, 2022]. Retrieved from the internet: URL: https://www.linquip.com/blog/cooling-tower-fill-materiala/; 3 pgs.
Dai, "Increasing drought under global warming in observations and models", Nat. Clim. Change 2013, 3(1):52-58.
Darling et al., "Pathways to low-cost electrochemical energy storage: a comparison of aqueous and nonaqueous flow batteries", Energy Environ. Sci. 2014, 7 (11), 3459-3477.
Dean and Lowenstein, "A Solar Liquid-Desiccant Air Conditioner for Low-electricity Humidity Control-Summary Report," Energy and Water Projects Demonstration Plan SI-0822; TP-7 M0-56437-2, Nov. 2012; 41 pgs.
Desai et al., "Electrochemical Desalination of Seawater and Hypersaline Brines with Coupled Electricity Storage", ACS Energy Lett. 3, 2, 2018, pp. 375-379.
Desalination Experts Group, "Desalination in the GCC", 2014, 47 pages.
Dipaola, "Saudi Arabia Gets Cheapest Bids for Solar Power in Auction" Bloomberg, Jan. 16, 2018, 3 pages.
Ebrahimi et al., "Numerical study of liquid flow and heat transfer in rectangular microchannel with longitudinal vortex generators," Applied Thermal Eng, 2015; 78:576-583.
Epsztein et al., "Activation behavior for ion permeation in ion-exchange membranes: Role of ion dehydration in selective transport", Journal of Membrane Science 580, 2019, pp. 316-326.
European Search Report for EP22151282.5 issued by the European Patent Office, Jun. 3, 2022; 10 pgs.
Extended European Search Report for EP 22150661.1 issued by the European Patent Office on Jun. 9, 2022; 14 pgs.
Extended European Search Report for European Application No. 22157879.4, dated Aug. 26, 2022, 10 pages.
Ferguson et al., "Studies On Overvoltage. IX: The Nature of Cathode and Anode Discharge Potentials at Several Metal Surfaces1,2", J. Phys. Chem. (1937); 42(2):171-190.
Friedman et al. "Mapping Microscale Chemical Heterogeneity in Nation Membranes with X-ray Photoelectron Spectroscopy," Journal of the Electrochemical Society, (2018); 165(11):733-741.
Gentry and Jacobi, "Heat Transfer Enhancement on a Flat Plate using Delta-Wing Vortex Generators," ACRC Project 40, Jul. 1995:109 pgs.
Gong et al., "A zinc-iron redox-flow battery under $100 per kWh of system capital cost", Energy & Environmental Science, 2015. 5 pages.
Gong et al., All-Soluble All-Iron Aqueous Redox-Flow Battery, ACS Energy Letters, 2016, 1, pp. 89-93.
Google Search for "liquid desiccant air conditioning electrodialysis" dated Mar. 9, 2021, 2 pages.
Gowin, "Examining the economics of seawater desalination using the DEEP code", Nuclear Power Technology Development Section, I. A. E. A., Ed. Vienna, Austria, (2000); 88 pages.
Gu et al., "A multiple ion-exchange membrane design for redox flow batteries", Energy Environ. Sci. 2014, 7 (9), pp. 2986-2998.
Guler et al. "Performance-determining membrane properties in reverse electrodialysis", Journal of Membrane Science, (2013); 446:266-276.
Guo, Y., et al., "Using electrodialysis for regeneration of aqueous lithium chloride solution in liquid desiccant air conditioning systems," Energy and Buildings, 2016, 116, pp. 285-295.
Hilbert et al., "Correlations between the Kinetics of Electrolytic Dissolution and Deposition of Iron: I . The Anodic Dissolution of Iron", Journal of The Electrochemical Society 1971, 118(12):1919-1926.
Howell et al., "Overview of the DOE VTO Advanced Battery R&D Program", (Jun. 6, 2016); 24 pages.
Hu et al., "Long-Cycling Aqueous Organic Redox Flow Battery (AORFB) toward Sustainable and Safe Energy Storage", Journal of the American Chemical Society 2017, 139 (3), 1207-1214.
International Preliminary Report on Patentability for PCT/US2019/062471 dated May 25, 2021, 7 pages.
International Search Report and Written Opinion for International Application No. PCT/US2019/062924, mailed Mar. 9, 2020, 12 pages.
International Search Report and Written Opinion for International Application No. PCT/US2019/063157, mailed Mar. 9, 2020, 11 pages.
International Search Report and Written Opinion for International Application No. PCT/US2022/82272, mailed on Jun. 23, 2023, 15 pages.
International Search Report and Written Opinion for PCT Application No. PCT/US2023/065443 dated Jul. 31, 2023, 15 pages.
John et al., "Seasonal cycles of temperature, salinity and water masses of the western Arabian gulf", Oceanol. Acta 1990, 13 (3), 273-281.

(56) References Cited

OTHER PUBLICATIONS

Kaibara et al., "Study of Ion Transport across Amphoteric Ion Exchange Membrane. II. Transport of Symmetric Tetraalkylammonium Chlorides", Bull. Chem. Sco. Jpn, 56, 1983, pp. 1346-1350.
Khawaji et al., "Advances in seawater desalination technologies", Desalination 2008, 221 (1-3), 47-69.
Konopka et al., "Diffusion coefficients of ferri- and ferrocyanide ions in aqueous media, using twin-electrode thin-layer electrochemistry", Anal. Chem. (1970); 42(14):1741-1746.
Kozubal et al., "Low-Flow Liquid Desiccant Air-Conditioning: Demonstrated Performance and Cost Implications" NREL Technical Report, Sep. 2014, 104 pages.
La Mantia et al., "Batteries for efficient energy extraction from a water salinity difference", Nano Lett. 2011, 11 (4), 1810-3.
"Lazard's Levelized Cost of Storage—Version 2.0." 2016, 46 pages.
Lee et al., "Desalination of a thermal power plant wastewater by membrane capacitive deionization", Desalination 196, 2006, pp. 125-134.
Lee et al., "Rocking chair desalination battery based on Prussian blue electrodes", ACS Omega 2017, 2 (4), 1653-1659.
Li et al., "Numerical simulation on flow and heat transfer of fin-and-tube heat exchanger with longitudinal vortex generators," Intl J Thermal Sci; 2015; 92:85-96.
Li et al., "Photovoltaic-electrodialysis regeneration method for liquid desiccant cooling system", Solar Energy, vol. 83, 2009, pp. 2195-2204.
Li, F., et al., "Novel spacers for mass transfer enhancement in membrane separations," Journal of Membrane Science, May 2005; 253(1-2): 1-12.
Ling, Y., et al., "CFD simulation of fluid flow through spacer-filled membrane module: selecting suitable cell types for periodic boundary conditions," Desalination, 2008; 233(1):351-358.
Logan et al, "Membrane-based processes for sustainable power generation using water", Nature 2012, 488, 313.
Loutatidou, et al., "Capital cost estimation of RO plants: GCC countries versus southern Europe", Desalination 2014, 347, 103-111.
Lu et al., "Numerical simulation on performances of plane and curved winglet-Pair vortex generators in a rectangular channel and field synergy analysis," Intl J Thermal Sci, 2016;109:323-333.
Malhotra et al., "Use cases for stationary battery technologies: A review of the literature and existing projects", Renewable and Sustainable Energy Reviews 56, 2016, pp. 705-721.
Mathsisfun "Polygons" 7 pages, 2020, https://www.mathsisfun.com/geometry/polygons.html#:~:text=Polygons%20are%202-dimensional%20shapes.%20They%20are%20made%20of,Greek.%20Poly-%20means%20%22many%22%20and%20-gon%20means%20%22angle%22, 7 pages (Year: 2020).
Mcgovern et al., "On the cost of electrodialysis for the desalination of high salinity feeds", Applied Energy 136, Dec. 2014, pp. 649-661.
Moore et al., "Evaporation from Brine Solutions Under Controlled Laboratory Conditions; Report 77 for the Texas Water Development Board", May 1968, 77 pages.
Nair et al., "Water desalination and challenges: The Middle East perspective: a review", Desalin. Water Treat. 2013, 51 (10-12), 2030-2040.
Oren, "Capacitive deionization (CDI) for desalination and water treatment- past, present and future (a review)", Desalination 2008, 228 (1-3), 10-29.
Pasta et al., "A desalination battery" Nano Lett.2012, 12 (2), 839-43.
Patankar and Prakash, "An Analysis of the Effect of Plate Thickness on Laminar Flow and Heat Transfer in Interrupted-Plate Passages," Intl J Heat Mass Transfer, 1981; 24(11):1801-1810.
Patil et al., "Diffusivity of some zinc and cobalt salts in water", J. Chem. Eng. Data 1993, 38 (4), 574-576.
Petrova et al., "Perfluorinated hybrid membranes modified by metal decorated clay nanotubes", Journal of Membrane Science, vol. 582, Jul. 15, 2019, pp. 172-181.
Pismenskaya et al., "Can the electrochemical performance of heterogeneous ion-exchange membranes be better than that of homogeneous membranes?", Journal of Membrane Science, vol. 566, Nov. 15, 2018, pp. 54-68.
Sadrzadeh et al., "Sea water desalination using electrodialysis", Desalination 2008, 221 (1), 440-447.
Schaetzle et al., "Salinity Gradient Energy: Current State and New Trends", Engineering, vol. 1, Issue 2, Jun. 2016, pp. 164-166.
Scialdone et al., "Investigation of electrode material-Redox couple systems for reverse electrodialysis processes. Part 1: Iron redox couples", Journal of Electroanalytical Chemistry 2012, 681 (Supplement C), 66-75.
Scialdone et al., "Investigation of electrode material-redox couple systems for reverse electrodialysis processes—Part II: Experiments in a stack with 10-50 cell pairs", Journal of Electroanalytical Chemistry, vol. 704, Jun. 14, 2013, pp. 1-9.
Seto et al., "Seawater desalination by electrodialysis," Desalination, (1978); 25(1):1-7.
Shah et al., "Comparative Studies on Performance of Interpolymer and Heterogeneous ion-Exchange Membranes for Water Desalination by Electrodialysis", Desalination 172, 2005, pp. 257-265.
Shamshery et al., "Modeling the future of irrigation: A parametric description of pressure compensating drip irrigation miller performance," PLoS ONE, 2017; 12{4): e0175241: 24 pgs.
Solveichik, "Flow batteries: current status and trends", Chem. Rev. (2015); 115(20):11533-11558.
Song et al., "Interaction of counter rotating longitudinal vortices and the effect on fluid flow and heat transfer," Intl J Heat Mass Transfer, 2016; 93:349-360.
Stillwell et al., "Predicting the specific energy consumption of reverse osmosis desalination", Water 2016, 8 (12), 18 pages.
Tiggelbeck et al., "Experimental investigations of heat transfer enhancement and flow losses in a channel with double rows of longitudinal vortex generators," Intl J Heat Mass Transfer, 1993; 36(9):2327-2337.
"Two Stage Regenerator," AIL Research, Inc., available online [retrieved on Mar. 1, 2022]. Retrieved from the Internet: URL: http://ailr.com/our-technology/two-stage-regenerator/; 1 pg.
Urban, "Emerging Scientific and Engineering Opportunities within the Water-Energy Nexus", Joule, Dec. 20, 2017, pp. 665-688.
US Dept. of Energy, "Desiccant Enhanced Evaporative Air-Conditioning (DEVap): Evaluation of a New Concept in Ultra Efficient Air Conditioning," Technical Report NREL/TP-5500-49722, (2011), 71 pages.
US Dept. of Energy, "Energy Savings Potential and RD&D Opportunities for Commercial Building HVAC Systems", Dec. 2017, 172 pages.
US Dept. of Interior/US Geological Survey, "Estimated Use of Water in the United States in 2010," 2014, 64 pages.
U.S. Office Action for U.S. Appl. No. 16/200,309, Apr. 20, 2022; 23 pgs.
Vermaas et al., "High Efficiency in Energy Generation from Salinity Gradients with Reverse Electrodialysis", ACS Sustainable Chem. Eng. 1, 2013, pp. 1295-1302.
Viswanathan et al., Cost and performance model for redox flow batteries, Journal of Power Sources, (2012); 247:1040-1051.
Vitillo et al., "Flow analysis of an innovative compact heat exchanger channel geometry," Intl J Heat Fluid Flow, 2016; 58:30-39.
Wang et al., "Continuous desalination with a metal-free redox-mediator", Journal of Materials Chemistry A, No. 7, 2019, 7 pages.
Woods, "Membrane processes for heating, ventilation, and air conditioning", Renewable and Sustainable Energy Reviews, vol. 33, 2014, pp. 290-304.
Wu and Tao, "Effect of longitudinal vortex generator on heat transfer in rectangular channels," Applied Thermal Engineering; 2012; 37:67-72.
Wu and Tao, "Numerical Study on laminar convection heat transfer in a channel with longitudinal vortex generator. Part B: Parametric study of major influence factors," Intl J Heat Mass Transfer, 2008; 51:3683-3692.
Wu et al., "Kinetic study on regeneration of Fe(II)EDTA in the wet process of NO removal", Chemical Engineering Journal 2008, 140 (1), 130-135.

(56) References Cited

OTHER PUBLICATIONS

Ye et al., "Performance of a mixing entropy battery alternately flushed with wastewater effluent and seawater for recovery of salinity gradient energy", Energy Environ. Sci. 2014, 7 (7), 2295-2300.
Zhang et al., "A Natural Driven Membrane Process for Brackish and Wastewater Treatment: Photovoltaic Powered ED and FO Hybrid System", Environmental Science and Technology, Sep. 4, 2013, pp. 10548-10555.
Zhang et al., "The mechanism of heat transfer enhancement using longitudinal vortex generators in a laminar channel flow with uniform wall temperature," Intl J Thermal Sci, 2017; 17:26-43.
Kalpana et al., "Developments in liquid dessicant dehumidifcation system integrated with evaporative cooling technology," International Journal of Energy Research, vol. 46, No. 1, Apr. 2, 2021, pp. 61-88.
[Author Unknown] "Advantix Systems, Dehumidification-Cooling System." Retrieved online. URL: www.achrnews.com/articles/116312-advantix-systems-dehumidification-cooling-system, Dec. 27, 2010; 1 page.
[Author Unknown] "Advantix Systems, DuTreat Series (DT); The Advantage are Built In: Better Cleaner and More Efficient Cooling Systems." [Product Datasheet]. Date Unknown; 2 pages.
[Author Unknown] "Munters, CELdek® Evaporative cooling pad." [Product Datasheet], Munters AB, 2022; 2 pages.
[Author Unknown] "Munters, GLASdek GX30 and GX35 Single-coated evaporative cooling and humidification media with competitive performance." [Product Datasheet], Munters AB, 2023; 4 pages.
Bassuoni MM "An experimental study of structured packing dehumidifier/regenerator operating with liquid desiccant." Energy. May 2011; 36(5):2628-2638.
Franco et al. "Aerodynamic analysis and CFD simulation of several cellulose evaporative cooling pads used in Mediterranean greenhouses." Computers and Electronics in Agriculture. May 2011;76(2):218-230.
Gunhan et al. "Evaluation of the suitability of some local materials as cooling pads." Biosystems Engineering. Mar. 2007;96(3):369-377.
Jain et al. "Performance analysis of liquid desiccant dehumidification systems." International Journal of Refrigeration. Aug. 2007;30(5):861-872.
Mohammad et al. "Theoretical study of the effect of liquid desiccant mass flow rate on the performance of a cross flow parallel-plate liquid desiccant-air dehumidifier." Heat and Mass Transfer. Nov. 2013;49(11):1587-1593.
International Preliminary Report on Patentability for International Application No. PCT/US2023/065443 mailed Oct. 24, 2024, 8 pages.

* cited by examiner

LIQUID DESICCANT AIR CONDITIONING USING AIR AS HEAT TRANSFER MEDIUM

SUMMARY

The present disclosure relates generally to air dehumidifying systems that utilize liquid desiccant.

The present disclosure is directed to a liquid desiccant system where heat and mass transfer occurs only at a liquid/air interface within the desorber unit and absorber unit. The liquid desiccant system may not include a desiccant-to-liquid (such as water or refrigerant) heat exchanger, thus reducing complexity and cost of the liquid desiccant system while enabling a highly efficient air dehumidifying system.

The present disclosure is directed to a liquid desiccant system including a liquid desiccant loop having an absorber unit in fluid communication with a desorber unit and liquid desiccant flowing between the absorber unit and the desorber unit. The liquid desiccant system includes a supply airflow path passing through the absorber unit and forming an absorber liquid/air interface within the absorber unit and a conditioned airflow exiting the absorber unit. The liquid desiccant system includes a regeneration airflow path passing through the desorber unit and forming a desorber liquid/air interface within the desorber unit and an exhaust airflow exiting the desorber unit. A heat exchanger is thermally coupled to the supply airflow path for removing heat from supply airflow upstream of the absorber unit. A heat exchanger is thermally coupled to the regeneration airflow path adding heat to regeneration airflow upstream of the desorber unit. At least 95%, or at least 99% of the total heat added to the liquid desiccant may be added at the desorber liquid/air interface.

The present disclosure is directed to a liquid desiccant system including a liquid desiccant loop having an absorber unit in fluid communication with a desorber unit and liquid desiccant flowing between the absorber unit and the desorber unit. The liquid desiccant system includes a supply airflow path passing through the absorber unit and forming an absorber liquid/air interface within the absorber unit and a conditioned airflow exiting the absorber unit. The liquid desiccant system includes a regeneration airflow path passing through the desorber unit and forming a desorber liquid/air interface within the desorber unit and an exhaust airflow exiting the desorber unit. A heat exchanger is thermally coupled to the supply airflow path for removing heat from supply airflow upstream of the absorber unit. The heat exchanger is also thermally coupled to the regeneration airflow path adding heat to regeneration airflow upstream of the desorber unit. At least 95%, or at least 99% of the total heat added to the liquid desiccant may be added at the desorber liquid/air interface.

The present disclosure is directed to a method of conditioning an airflow including circulating liquid desiccant through a liquid desiccant loop including an absorber unit in fluid communication with a desorber unit and liquid desiccant, flowing supply air along a supply airflow path and through the absorber unit to form an absorber liquid/air interface within the absorber unit and a conditioned airflow exiting the absorber unit, and flowing regeneration air along a regeneration airflow path and through the desorber unit to form a desorber liquid/air interface within the desorber unit and an exhaust airflow exiting the desorber unit. The method includes removing heat from the supply air upstream of the absorber unit and adding heat to the regeneration airflow upstream of the desorber unit. The liquid desiccant has a first temperature exiting the desorber unit and a second temperature entering the absorber unit and the first and second temperature at within 5% of each other, or within 1% of each other, or are equal. At least 95%, or at least 99% of the total heat added to the liquid desiccant may be added at the desorber liquid/air interface.

The present disclosure is directed to a method of conditioning an airflow including circulating liquid desiccant through a liquid desiccant loop comprising an absorber unit in fluid communication with a desorber unit and liquid desiccant, flowing supply air along a supply airflow path and through the absorber unit to form an absorber liquid/air interface within the absorber unit and a conditioned airflow exiting the absorber unit, and flowing regeneration air along a regeneration airflow path and through the desorber unit to form a desorber liquid/air interface within the desorber unit and an exhaust airflow exiting the desorber unit. The method includes removing heat from the supply air upstream of the absorber unit and adding the heat to the regeneration airflow upstream of the desorber unit. The liquid desiccant has a first temperature exiting the desorber unit and a second temperature entering the absorber unit and the first and second temperature at within 5% of each other, or within 1% of each other, or are equal. At least 95%, or at least 99% of the total heat added to the liquid desiccant may be added at the desorber liquid/air interface.

The present disclosure is directed to a liquid desiccant system including a liquid desiccant loop having an absorber unit in fluid communication with a desorber unit and liquid desiccant flowing between the absorber unit and the desorber unit. The liquid desiccant system includes a supply airflow path passing through the absorber unit and forming an absorber liquid/air interface within the absorber unit and a conditioned airflow exiting the absorber unit. The liquid desiccant system includes a regeneration airflow path passing through the desorber unit and forming a desorber liquid/air interface within the desorber unit and an exhaust airflow exiting the desorber unit. A heat exchanger is thermally coupled to the supply airflow path for removing heat from supply airflow upstream of the absorber unit. The heat exchanger is also thermally coupled to the regeneration airflow path adding heat to regeneration airflow upstream of the desorber unit. The liquid desiccant loop does not include a refrigerant-to-liquid heat exchanger or a water-to-liquid desiccant heat exchanger.

The present disclosure is directed to a method of conditioning an airflow including circulating liquid desiccant through a liquid desiccant loop including an absorber unit in fluid communication with a desorber unit and liquid desiccant, flowing supply air along a supply airflow path and through the absorber unit to form an absorber liquid/air interface within the absorber unit and a conditioned airflow exiting the absorber unit, and flowing regeneration air along a regeneration airflow path and through the desorber unit to form a desorber liquid/air interface within the desorber unit and an exhaust airflow exiting the desorber unit. The method includes removing heat from the supply air upstream of the absorber unit and adding heat to the regeneration airflow upstream of the desorber unit. The liquid desiccant loop does not include a refrigerant-to-liquid heat exchanger or a water-to-liquid desiccant heat exchanger.

BRIEF DESCRIPTION OF THE DRAWINGS

The discussion below makes reference to the following figures, wherein the same reference number may be used to identify the similar/same component in multiple figures. The figures are not necessarily to scale.

DETAILED DESCRIPTION

Figure 1:
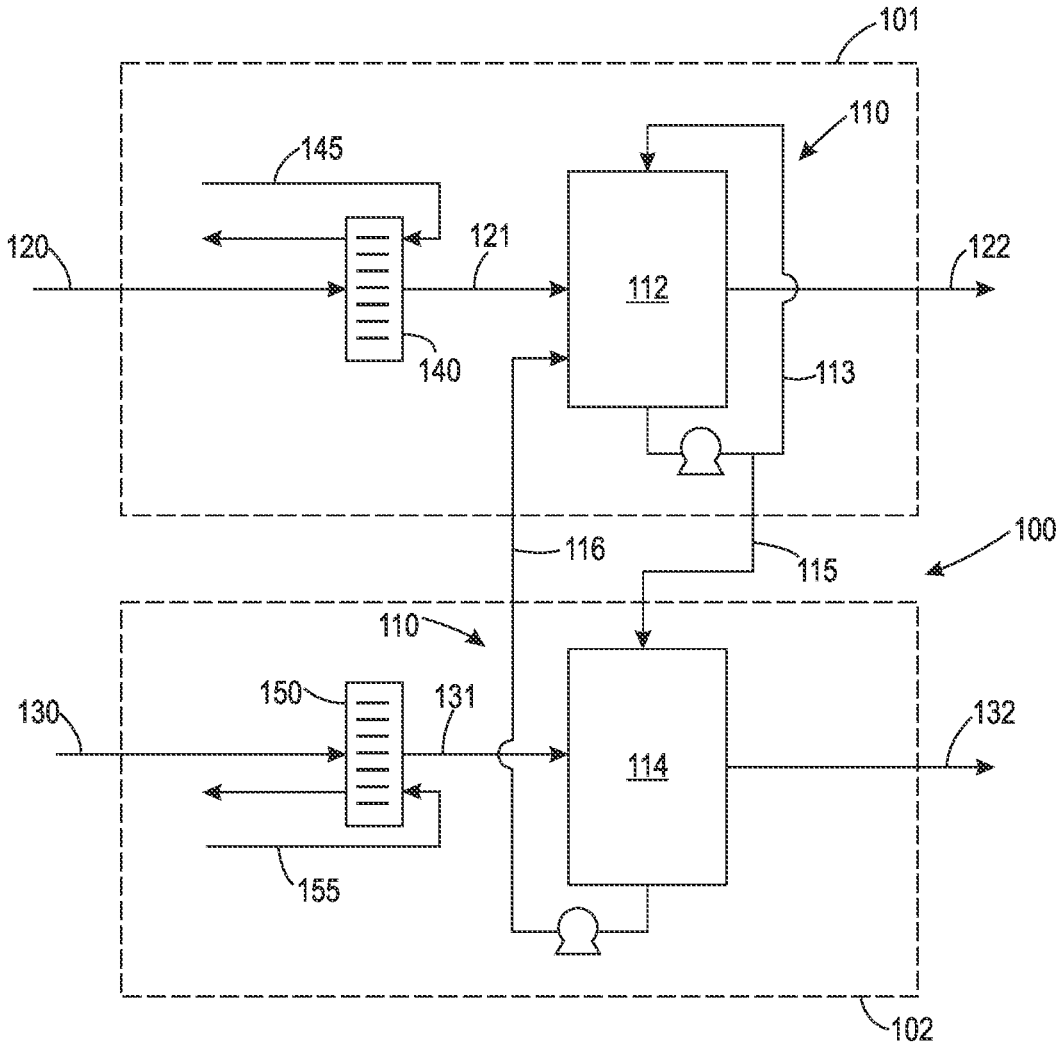
FIG. 1 is a schematic diagram of an illustrative liquid desiccant system.

The present disclosure is generally related to heating, ventilation, and air-conditioning (HVAC) systems. In one example embodiment, a gas-to-liquid vapor exchanger includes an absorber unit and a desorber unit to regenerate a liquid desiccant passing thorough both units. These units can be used to absorb and desorb water vapor into and out of the liquid desiccant to dehumidify or humidify air. This humidification and dehumidification can be used in HVAC heating and cooling applications.

Air conditioning systems may simultaneously perform two functions: first to dehumidify and second to cool a forced air stream. Commonly used air conditioning systems use vapor compression, which can both dehumidify and cool the incoming air. However, given a humid air stream, vapor compression may rely on cooling the air stream to below its delivery temperature to condense the moisture and achieve a low absolute humidity, then re-heating the air to its delivery temperature. This moisture condensation process dramatically increases the energy requirement of air conditioners, especially in humid climates. An alternative dehumidification method, known as liquid desiccant dehumidification, can substantially decrease the energy intensity of air conditioning, and is the subject of the present disclosure.

Removing moisture from air using a liquid desiccant is an energy-efficient alternative to vapor compression, since it minimizes or removes the need for cooling and reheating the air stream. In a liquid desiccant dehumidification system, the humid air exchanges water vapor with the liquid desiccant. A gas-to-liquid vapor exchanger (absorber unit) may be used to contact humid air and a liquid desiccant and transfer water vapor in the humid air into the liquid desiccant to form a loaded liquid desiccant. This loaded liquid desiccant may be regenerated in a gas-to-liquid vapor exchanger (desorber unit) by heating the loaded liquid desiccant to drive off water vapor and return the regenerated liquid desiccant to the absorber unit.

The present disclosure is directed to a liquid desiccant system where heat and mass transfer occurs only at a liquid/air interface within the desorber unit and absorber unit. Heat is added or removed from the liquid desiccant only at the liquid/air interface within the desorber unit and absorber unit. The liquid desiccant system may not include a desiccant-to-liquid (such as water or refrigerant) heat exchanger, thus reducing complexity and cost of the liquid desiccant system while enabling a highly efficient air dehumidifying system.

Current liquid desiccant air conditioning systems utilize cooling and heating of the liquid desiccant using heat exchangers. These heat exchanges are typically counter-flow unit operations that provide a heating or cooling liquid flowing in a first direction and the liquid desiccant flowing in an opposite direction and transferring heat via thermal conduction through the heat exchanger conduit walls. These heat exchangers are formed of exotic materials to handle the corrosive liquid desiccant and are thus expensive and complex.

The present disclosure eliminates these desiccant-to-liquid heat exchangers while providing a highly efficient liquid desiccant air conditioning system. The present disclosure provides a simplified liquid desiccant air conditioning system that may be easily retrofitted onto traditional air conditioning systems. The present disclosure describes a highly efficient liquid desiccant air conditioning system that utilizes standard air coils to heat and cool the air entering the absorber unit and the desorber unit. The air passing through the absorber unit and the desorber unit provides the heating and cooling of the liquid desiccant. This simplifies system architecture, removes expensive parts, and opens the door to liquid desiccant retrofits of existing traditional air conditioners.

Figure 2:
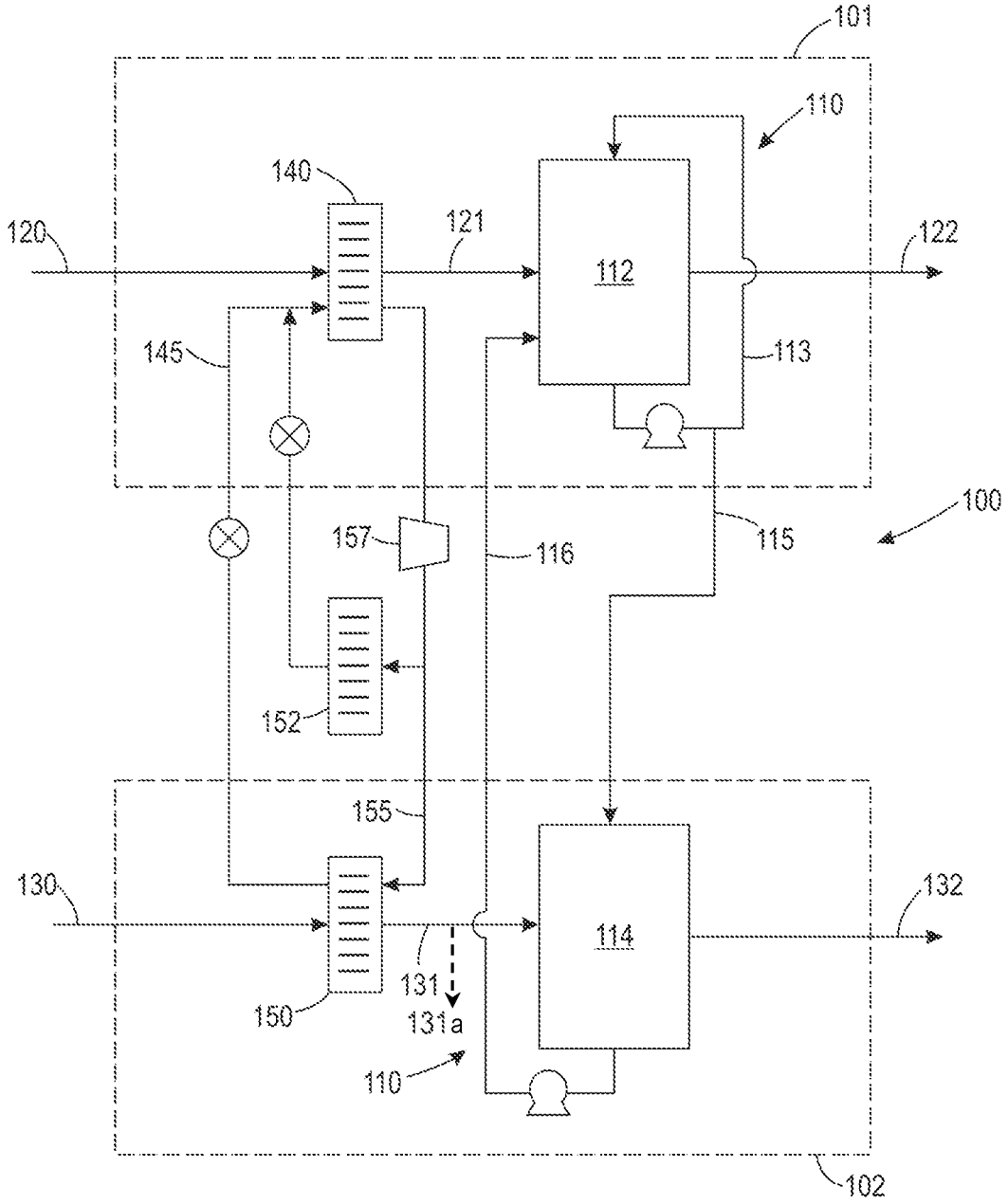
FIG. 2 is a schematic diagram of another illustrative liquid desiccant system.

FIG. 1 is a schematic diagram of an illustrative liquid desiccant system 100. FIG. 2 is a schematic diagram of another illustrative liquid desiccant system 100. The liquid desiccant system 100 of FIG. 2 illustrates heat removed from an absorber operation 101 is added to the desorber operation 102. The liquid desiccant system 100 of FIG. 1 illustrates that heat is removed from the absorber operation 101 via a heat sink 145 and heat is added to the desorber operation 102 via a heat source 155. The heat sink 145 may be any useful heat sink unit operation that removes heat from the absorber operation 101, such as, refrigerant-to-air condenser coil, chilled water coil, evaporative coolers, and the like. The heat source 155 may be any useful heat source unit operation that provides heat to the desorber operation 102 such as, electric heat, gas-fired heat, solar heat, geothermal heat, condenser coil, and the like.

The liquid desiccant system 100 includes a liquid desiccant loop 110 having an absorber unit 112 in fluid communication with a desorber unit 114 and liquid desiccant flowing between the absorber unit 112 and the desorber unit 114.

The liquid desiccant system 100 includes a supply airflow path 120 passing through the absorber unit 112 and forming an absorber liquid/air interface within the absorber unit 112 and a conditioned airflow 122 exiting the absorber unit 112. The liquid desiccant system 100 includes a regeneration airflow path 130 passing through the desorber unit 114 and forming a desorber liquid/air interface within the desorber unit 114 and an exhaust airflow 132 exiting the desorber unit 114.

A heat exchanger 140 is thermally coupled to the supply airflow path 120 for removing heat from supply airflow 120 upstream of the absorber unit 112. A heat exchanger 150 is thermally coupled to the regeneration airflow path 130 adding heat to regeneration airflow 130 upstream of the desorber unit 114.

The liquid desiccant has a first temperature exiting the absorber unit 112 and a second temperature entering the desorber unit 114, and the first and second temperature are within 5% of each other, or within 1% of each other, or are equal. At least 95%, or at least 99% of the total heat added to the liquid desiccant may be added at the desorber liquid/air interface.

The liquid desiccant has a first temperature exiting the desorber unit 114 and a second temperature entering the absorber unit 112, and the first and second temperature are within 5% of each other, or within 1% of each other, or are equal. At least 95%, or at least 99% of the total heat removed to the liquid desiccant may be removed at the absorber liquid/air interface.

In the absorber operation 101, the heat exchanger 140 may include an evaporator coil within the supply airflow path 120 configured to remove heat from the supply airflow. Cooled supply airflow 121 then enters the absorber unit 112 to both cool (remove heat from) the liquid desiccant and transfer humidity from the cooled supply airflow to the liquid desiccant at the absorber liquid/air interface.

The absorber liquid/air interface may be formed by any vapor/liquid mass transport unit operation. Illustrative vapor/liquid mass transport unit operation include, for example, packed beds, tray towers, spray towers, bubble columns, membranes, and the like.

Both heat and mass transfer occur only at a liquid/air interface within the absorber unit 112 for the absorber operation 101. Heat is not removed from the liquid desiccant outside of the absorber unit 112.

In the desorber operation 102, the heat exchanger 150 may include a condenser coil within the regeneration airflow path 130 configured to add heat to the regeneration airflow. Heated regeneration airflow 131 then enters the desorber unit 114 to both heat the liquid desiccant and transfer moisture from the liquid desiccant to the heated regeneration airflow at the desorber liquid/air interface.

The desorber liquid/air interface may be formed by any vapor/liquid mass transport unit operation. Illustrative vapor/liquid mass transport unit operation include, for example, packed beds, tray towers, spray towers, bubble columns, membranes, and the like.

Both heat and mass transfer occur only at a liquid/air interface within the desorber unit 114 for the desorber operation 102. Heat is not added from the liquid desiccant outside of the desorber unit 114.

The system or liquid desiccant loop 110 does not include a refrigerant-to-liquid heat exchanger or a water-to-liquid desiccant heat exchanger. The liquid desiccant loop is a closed loop that does not include a heat exchanger unit operation, other than the heat exchange at the liquid/air interfaces within the absorber unit 112 and desorber unit 114. Heat is not added or removed from the liquid desiccant outside of the absorber unit 112 or the desorber unit 114. The liquid desiccant loop 110 includes one or more liquid pumps and it is assumed that the liquid pumps do not add appreciable heat to the liquid desiccant through the pumping action of the liquid pumps.

The liquid desiccant loop 110 may include an absorber recycle loop 113. The absorber recycle loop 113 takes liquid desiccant from the absorber unit 112 and pumps it back into the absorber unit 112. The liquid desiccant loop 110 includes transfer piping 115 to fluidly connect the liquid desiccant from the absorber unit 112 to the desorber unit 114. The liquid desiccant loop 110 includes transfer piping 116 to fluidly connect the liquid desiccant from the desorber unit 114 to the absorber unit 112.

FIG. 1 and FIG. 2 illustrate a desorber unit 114 having a single pass of liquid desiccant through the desorber unit 114. The mass flow rate of liquid desiccant through the desorber unit 114 is substantially equal to the to the mass flow rate of liquid desiccant entering the desorber unit 114 via transfer piping 115 from the absorber unit 112. The mass flow rate of liquid desiccant through the desorber unit 114 is substantially equal to the to the mass flow rate of liquid desiccant leaving the desorber unit 114 via transfer piping 116 to the absorber unit 112.

Alternatively, the liquid desiccant loop 110 may include a desorber recycle loop (not shown). The desorber recycle loop takes liquid desiccant from the desorber unit 114 and pumps it back into the desorber unit 114. In these embodiments, the mass flow rate of liquid desiccant through the desorber unit 114 is greater than either of the mass flow rate of liquid desiccant entering the desorber unit 114 via transfer piping 115 from the absorber unit 112, or the mass flow rate of liquid desiccant leaving the desorber unit 114 via transfer piping 116 to the absorber unit 112.

The liquid desiccant has a first temperature exiting the absorber unit 112 and a second temperature entering the desorber unit 114 via piping 115. The first and second temperature are within 5% of each other, or within 1% of each other, or are equal. Heat is not added to the liquid desiccant along the piping 115 from the absorber unit 112 to the desorber unit 114. Heat is not removed from the liquid desiccant along the piping 115 from the absorber unit 112 to the desorber unit 114. Heat is not added or removed along the recycle piping 113, other than minor amounts added by the fluid pumps via pumping.

The liquid desiccant has a first temperature exiting the desorber unit 114 and a second temperature entering the absorber unit 112 via piping 116. The first and second temperature are within 5% of each other, or within 1% of each other, or are equal. Heat is not added to the liquid desiccant along the piping 116 from the desorber unit 114 to the absorber unit 112. Heat is not removed from the liquid desiccant along the piping 116 from the desorber unit 114 to the absorber unit 112. Heat is not added to any desorber unit 114 recycle piping (when present) other than minor amounts added by the fluid pumps via pumping.

The regeneration airflow 130, 131 into the desorber unit 114 has a regeneration mass airflow rate value and liquid desiccant flowing through the desorber unit 114 has a desorber liquid desiccant mass flow rate value. The regeneration mass airflow rate value is in a range from 40 to 80 times the desorber liquid desiccant mass flow rate value. The regeneration mass airflow rate value is in a range from 50 to 70 times the desorber liquid desiccant mass flow rate value. The regeneration mass airflow rate value is in a range from 55 to 65 times the desorber liquid desiccant mass flow rate value.

The supply airflow 120, 121 into the absorber unit 112 has a supply mass airflow rate value and liquid desiccant flowing through the absorber unit 112 has an absorber liquid desiccant mass flow rate value. The supply mass airflow rate value is in a range from 1 to 10 times the absorber liquid desiccant mass flow rate value. The supply mass airflow rate value is in a range from 1 to 10 times the absorber liquid desiccant mass flow rate value. The supply mass airflow rate value is in a range from 1 to 5 times the absorber liquid desiccant mass flow rate value. The supply mass airflow rate value is in a range from 1 to 3 times the absorber liquid desiccant mass flow rate value.

The liquid desiccant may flow through the absorber unit 112 at an absorber liquid desiccant mass flow rate value and liquid desiccant may flow through the desorber unit 114 at a desorber liquid desiccant mass flow rate value. The desorber liquid desiccant mass flow rate value is from 0.5% to 5% of the absorber liquid desiccant mass flow rate value. The desorber liquid desiccant mass flow rate value is from 0.5% to 4% of the absorber liquid desiccant mass flow rate value. The desorber liquid desiccant mass flow rate value is from 1% to 3% of the absorber liquid desiccant mass flow rate value.

The liquid desiccant may be a halide salt solution. The halide salt can be selected from sodium chloride (NaCl), potassium chloride (KCl), potassium iodide (KI), lithium chloride (LiCl), copper (II) chloride ($CuCl_2$), silver chloride (AgCl), calcium chloride ($CaCl_2$)), chlorine fluoride (ClF), bromomethane ($CH_3Br$), iodoform ($CHI_3$), hydrogen chloride (HCl), lithium bromide (LiBr) hydrogen bromide (HBr), and combinations thereof. In some embodiments, the halide salt solution is selected from LiCl, NaCl, LiBr, and $CaCl_2$). In some embodiments, the halide salt solution is LiCl. The solution may be water and described as an aqueous solution. The halide salt may be present in the liquid desiccant in a range from 2 to 50% wt, or in a range from 10 to 40% wt, or in a range from 20 to 40% wt.

The concentration value of liquid desiccant in the desorber unit 114 is greater than the concentration value of the liquid desiccant in the absorber unit 112. The concentration value of liquid desiccant in the desorber unit 114 may be 3% or greater, by weight, than the concentration value of the liquid desiccant in the absorber unit 112. The concentration value of liquid desiccant in the desorber unit 114 may be 4% or greater, by weight, than the concentration value of the liquid desiccant in the absorber unit 112. The concentration value of liquid desiccant in the desorber unit 114 may be 5% or greater, by weight, than the concentration value of the liquid desiccant in the absorber unit 112. The concentration value of liquid desiccant in the desorber unit 114 may be 6% or greater, by weight, than the concentration value of the liquid desiccant in the absorber unit 112. The concentration value of liquid desiccant in the desorber unit 114 may be 7% or greater, by weight, than the concentration value of the liquid desiccant in the absorber unit 112. The concentration value of liquid desiccant in the desorber unit 114 may be 8% or greater, by weight, than the concentration value of the liquid desiccant in the absorber unit 112.

The concentration value of liquid desiccant in the desorber unit 114 may be in a range from 3% to 15% greater, by weight, than the concentration value of the liquid desiccant in the absorber unit 112. The concentration value of liquid desiccant in the desorber unit 114 may be in a range from 3% to 10% greater, by weight, than the concentration value of the liquid desiccant in the absorber unit 112. The concentration value of liquid desiccant in the desorber unit 114 may be in a range from 5% to 15% greater, by weight, than the concentration value of the liquid desiccant in the absorber unit 112. The concentration value of liquid desiccant in the desorber unit 114 may be in a range from 5% to 10% greater, by weight, than the concentration value of the liquid desiccant in the absorber unit 112.

The liquid desiccant system 100 of FIG. 2 illustrates heat removed from an absorber operation 101 is added to the desorber operation 102. A vapor compressor 157 moves the refrigerant and heat from the supply airflow 120 to the regeneration airflow 130. The heat removed from the supply airflow 120 is added to the regeneration airflow 130. Additional heat from the vapor compressor 157 may also be added to the regeneration airflow 130.

In some embodiments, a portion of the heat removed from the supply airflow 120 is dissipated in a condenser unit 152 not along the regeneration airflow path 130. In other embodiments a portion 131*a* of the regeneration airflow is removed from the regeneration airflow path between the heat exchanger 150 and the desorber unit 114.

A method of conditioning an airflow includes circulating liquid desiccant through a liquid desiccant loop 110 including an absorber unit 112 in fluid communication with a desorber unit 114. The method includes flowing supply air along a supply airflow path 120 and through the absorber unit 112 to form an absorber liquid/air interface within the absorber unit 112 and a conditioned airflow 122 exiting the absorber unit 112. The method includes flowing regeneration air along a regeneration airflow path 130 and through the desorber unit 114 to form a desorber liquid/air interface within the desorber unit 114 and an exhaust airflow 132 exiting the desorber unit 114. The method includes removing heat from the supply air 120 upstream of the absorber unit 112 and adding heat to the regeneration airflow 130 upstream of the desorber unit 114. The liquid desiccant has a first temperature exiting the desorber unit 114 and a second temperature entering the absorber unit 112 and the first and second temperature at within 5% of each other, or within 1% of each other, or are equal. At least 95%, or at least 99% of the total heat added to the liquid desiccant may be added at the desorber unit 114 liquid/air interface.

The method includes flowing regeneration air 130 through the desorber unit 114 at a regeneration mass airflow rate value and flowing liquid desiccant through the desorber unit 114 at a desorber liquid desiccant mass flow rate value. The regeneration mass airflow rate value is in a range from 40 to 80 times the desorber liquid desiccant mass flow rate value. The regeneration mass airflow rate value is in a range from 50 to 70 times the desorber liquid desiccant mass flow rate value. The regeneration mass airflow rate value is in a range from 55 to 65 times the desorber liquid desiccant mass flow rate value.

The method may include flowing supply air 120 through the absorber unit 112 at a supply mass airflow rate value and flowing liquid desiccant through the absorber unit 112 at an absorber liquid desiccant mass flow rate value. The supply mass airflow rate value is in a range from 1 to 10 times the absorber liquid desiccant mass flow rate value. The supply mass airflow rate value is in a range from 1 to 5 times the absorber liquid desiccant mass flow rate value. The supply mass airflow rate value is in a range from 1 to 3 times the absorber liquid desiccant mass flow rate value.

The method may include flowing liquid desiccant through the absorber unit 112 at a first mass flow rate and flowing liquid desiccant from the absorber unit 112 to the desorber 114 at a second mass flow rate. The second mass flow rate is from 0.5% to 5% of the first mass flow rate. The second mass flow rate is from 0.5% to 4% of the first mass flow rate. The second mass flow rate is from 1% to 3% of the first mass flow rate.

The removing heat step may include flowing supply air through an evaporator coil 140 within the supply airflow path 120. Adding the heat may include flowing regeneration air through a condenser coil 150 within the regeneration airflow path 130. The method does not include a refrigerant-to-liquid desiccant heat exchanger or a water-to-liquid desiccant heat exchanger.

Example

In one embodiment, a supply airflow has a temperature of 21 degrees Celsius (70 degrees Fahrenheit) an absolute humidity of 0.0128 kg $H_2O$/kg air and a flow rate of 1000 CFM. An evaporator coil removes heat from the supply airflow to form a cooled supply airflow having a temperature of 15 degrees Celsius (60 degrees Fahrenheit) an absolute humidity of 77.3 and a flow rate of 1000 CFM entering the absorber unit. The liquid desiccant recirculating in the absorber unit and leaving the absorber unit has a temperature of 21 degrees Celsius (70 degrees Fahrenheit) and a flow rate to the desorber unit of 0.25 liters/min and a recirculation flow rate of 12 liters/min. The liquid desiccant is an aqueous solution containing about 25% wt desiccant (LiCl) in the absorber unit operation. The conditioned airflow exiting the absorber unit has a temperature of 21 degrees Celsius (70 degrees Fahrenheit) an absolute humidity of 0.0091 kg $H_2O$/kg air and a flow rate of 1000 CFM. The absorber air mass flow rate to absorber liquid desiccant mass flow rate is about 2.5:1.

In this embodiment, a regeneration airflow has a temperature of 21 degrees Celsius (70 degrees Fahrenheit) an absolute humidity of 0.0128 kg $H_2O$/kg air and a flow rate of 550 CFM. A condenser coil adds heat to the regeneration airflow to form a heated regeneration airflow having a temperature of 38 degrees Celsius (100 degrees Fahrenheit) an absolute humidity of 0.0127 kg $H_2O$/kg air and a flow rate of 550 CFM entering the desorber unit. The liquid desiccant circulating through the desorber unit and leaving the desorber unit has a temperature of 37 degrees Celsius (98 degrees Fahrenheit) and a flow rate of 0.19 liters/min. The liquid desiccant is an aqueous solution containing about 32% wt desiccant (LiCl) in the desorber unit operation. The exhaust airflow exiting the desorber unit has a temperature of 28 degrees Celsius (83 degrees Fahrenheit) an absolute humidity of 113 and a flow rate of 550 CFM. The desorber air mass flow rate to desorber liquid desiccant mass flow rate is about 61:1.

In this system, heat is added to the liquid desiccant only at the liquid/air interface within the desorber unit. In this system, heat is removed to the liquid desiccant only at the liquid/air interface within the absorber unit.

This example has demonstrated a surprising high moisture removal efficiency (MRE) of about 4 kg/kWh. MRE is the moisture removal rate (mass/time) divided by the electrical power input to the air conditioning or liquid desiccant system.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. The use of numerical ranges by endpoints includes all numbers within that range (e.g. 1 to 5 includes 1, 1.5, 2, 2.75, 3, 3.80, 4, and 5) and any range within that range.

The foregoing description has been presented for the purposes of illustration and description. It is not intended to be exhaustive or to limit the embodiments to the precise form disclosed. Many modifications and variations are possible in light of the above teachings. Any or all features of the disclosed embodiments can be applied individually or in any combination and are not meant to be limiting, but purely illustrative. It is intended that the scope of the invention be limited not with this detailed description, but rather, determined by the claims appended hereto.

The invention claimed is:

1. A liquid desiccant system comprising:

a liquid desiccant loop in fluid communication with an absorber unit and a desorber unit such that liquid desiccant is flowable between the absorber unit and the desorber unit;

a supply airflow path passing supply airflow at a supply temperature and an absolute humidity through the absorber unit and forming an absorber liquid/air interface within the absorber unit and a conditioned airflow path exiting the absorber unit;

a regeneration airflow path passing regeneration airflow at the supply temperature and the absolute humidity through the desorber unit and forming a desorber liquid/air interface within the desorber unit and an exhaust airflow path exiting the desorber unit; and a heat exchanger thermally coupled to the supply airflow path and configured to remove heat from the supply airflow upstream of the absorber unit, the heat exchanger thermally coupled to the regeneration airflow path and configured to add heat to the regeneration airflow upstream of the desorber unit, wherein the liquid desiccant loop between the absorber unit and the desorber unit is a closed loop that does not include a desiccant-to-liquid heat exchanger and does not include a desiccant-to-refrigerant heat exchanger.

2. The liquid desiccant system of claim 1, wherein at least 95% of total heat added to the liquid desiccant is added at the desorber liquid/air interface within the desorber unit.

3. The liquid desiccant system of claim 1, wherein the liquid desiccant has a first temperature exiting the absorber unit and a second temperature entering the desorber unit and the first temperature and second temperature are substantially equal.

4. The liquid desiccant system of claim 1, wherein the heat exchanger comprises an evaporator coil within the supply airflow path configured to remove heat from the supply airflow.

5. The liquid desiccant system of claim 1, wherein the heat exchanger comprises a condenser coil within the regeneration airflow path configured to add heat to the regeneration airflow.

6. The liquid desiccant system of claim 1, wherein the liquid desiccant loop between the absorber unit and the desorber unit only includes plumbing hardware, one or more pumps, and one or more filters.

7. The liquid desiccant system of claim 1, wherein the heat removed from the supply airflow is added to the regeneration airflow.

8. The liquid desiccant system of claim 7, wherein a portion of the heat removed from the supply airflow is dissipated in a condenser unit not along the regeneration airflow path.

9. The liquid desiccant system of claim 7, wherein a portion of the regeneration airflow is removed from the regeneration airflow path between the heat exchanger and the desorber unit.

10. The liquid desiccant system of claim 1, wherein the regeneration airflow into the desorber unit has a regeneration mass airflow rate value and liquid desiccant flowing through the desorber unit has a desorber liquid desiccant mass flow rate value, and the regeneration mass airflow rate value is in a range from 40 to 80 times the desorber liquid desiccant mass flow rate value.

11. The liquid desiccant system of claim 10, wherein the supply airflow into the absorber unit has a supply mass airflow rate value and liquid desiccant flowing through the absorber unit has an absorber liquid desiccant mass flow rate value, and the supply mass airflow rate value is in a range from 1 to 10 times the absorber liquid desiccant mass flow rate value.

12. The liquid desiccant system of claim 10, wherein liquid desiccant flows through the absorber unit at an absorber liquid desiccant mass flow rate value and liquid desiccant flows through the desorber unit at desorber liquid desiccant mass flow rate value, and the desorber liquid desiccant mass flow rate value is from 0.5% to 5% of the absorber liquid desiccant mass flow rate value and the desorber liquid desiccant mass flow rate value through the desorber unit is substantially equal to a liquid desiccant mass flow rate value from the absorber unit to the desorber unit.

13. The liquid desiccant system of claim 10, wherein liquid desiccant flows through the absorber unit at an absorber liquid desiccant mass flow rate value and liquid desiccant flows through the desorber unit at desorber liquid desiccant mass flow rate value, and the desorber liquid desiccant mass flow rate value is from 0.5% to 5% of the absorber liquid desiccant mass flow rate value and the desorber liquid desiccant mass flow rate value through the desorber unit is greater than a liquid desiccant mass flow rate value from the absorber unit to the desorber unit.

14. The liquid desiccant system of claim 1, wherein liquid desiccant comprises of LiCl, NaCl, LiBr, or $CaCl_2$).

15. The liquid desiccant system of claim 1, wherein liquid desiccant comprises LiCl.

16. The liquid desiccant system of claim 1, wherein a concentration value of liquid desiccant in the desorber unit is 3% or greater, by weight, than a concentration value of the liquid desiccant in the absorber unit.

17. The liquid desiccant system of claim 1, wherein a concentration value of liquid desiccant in the desorber unit is 5% or greater, by weight, than a concentration value of the liquid desiccant in the absorber unit.

18. The liquid desiccant system of claim 1, wherein, during operation, conditioned airflow and exhaust airflow are formed simultaneously.

19. The liquid desiccant system of claim 1, wherein the system is configured to minimize heat added to the liquid desiccant outside the desorber liquid/air interface within the desorber unit.

20. A method of conditioning an airflow comprising:

circulating liquid desiccant through a liquid desiccant loop between an absorber unit and a desorber unit, without circulating the liquid desiccant through a desiccant-to-liquid heat exchanger and without circulating the liquid desiccant through a desiccant-to-refrigerant heat exchanger;

flowing supply air from an air source along a supply airflow path and through the absorber unit to form an absorber liquid/air interface within the absorber unit and a conditioned airflow exiting the absorber unit;

concurrent to flowing the supply air, flowing regeneration air from the air source along a regeneration airflow path and through the desorber unit to form a desorber liquid/air interface within the desorber unit and an exhaust airflow exiting the desorber unit;

removing heat from the supply air upstream of the absorber unit; and adding heat to the regeneration air upstream of the desorber unit.

21. The method of claim 20, further comprising flowing the regeneration air through the desorber unit at a regeneration mass airflow rate value and flowing liquid desiccant through the desorber unit at a desorber liquid desiccant mass flow rate value, and the regeneration mass airflow rate value is in a range from 40 to 80 times the desorber liquid desiccant mass flow rate value.

22. The method of claim 21, further comprising flowing the supply air through the absorber unit at a supply mass airflow rate value and flowing liquid desiccant through the absorber unit at an absorber liquid desiccant mass flow rate value, and the supply mass airflow rate value is in a range from 1 to 10 times the absorber liquid desiccant mass flow rate value.

23. The method of claim 21, further comprising flowing liquid desiccant through the absorber unit at a first mass flow rate and flowing liquid desiccant from the absorber unit to the desorber unit at a second mass flow rate, and the second mass flow rate is from 0.5% to 5% of the first mass flow rate.

24. The method of claim 20, wherein removing heat comprises flowing the supply air through an evaporator coil within the supply airflow path, and adding the heat comprises flowing the regeneration air through a condenser coil within the regeneration airflow path.

25. The method of claim 20, wherein at least 95% of total heat added to the liquid desiccant is added at the desorber liquid/air interface within the desorber unit.

26. The method of claim 20, wherein at least 99% of total heat added to the liquid desiccant is added at the desorber liquid/air interface within the desorber unit.

27. The method of claim 20, wherein the circulating the liquid desiccant includes minimizing heat added to the liquid desiccant within the liquid desiccant loop outside the desorber liquid/air interface within the desorber unit.

28. The method of claim 20, wherein a concentration value of liquid desiccant in the desorber unit is 3% or greater, by weight, than a concentration value of the liquid desiccant in the absorber unit.

29. A liquid desiccant system comprising:

a liquid desiccant loop in fluid communication with an absorber unit and a desorber unit such that liquid desiccant is flowable between the absorber unit and the desorber unit;

a supply airflow path passing through the absorber unit and forming an absorber liquid/air interface within the absorber unit and a conditioned airflow path exiting the absorber unit;

a regeneration airflow path passing through the desorber unit and forming a desorber liquid/air interface within the desorber unit and an exhaust airflow path exiting the desorber unit; and a heat exchanger thermally coupled to the supply airflow path and to the regeneration airflow path, the heat exchanger configured to remove heat from supply airflow along the supply airflow path upstream of the absorber unit while adding heat to regeneration airflow along the regeneration airflow path upstream of the desorber unit, wherein the system is configured to minimize heat added to the liquid desiccant outside the desorber liquid/air interface within the desorber unit, and wherein the liquid desiccant loop between the absorber unit and the desorber unit is a closed loop that does not include a heat exchanger.

30. The liquid desiccant system of claim 29, wherein at least 99% of total heat added to the liquid desiccant is added at the desorber liquid/air interface within the desorber unit.

31. The liquid desiccant system of claim 30, wherein the liquid desiccant has a first temperature exiting the absorber unit and a second temperature entering the desorber unit and the first temperature and second temperature are substantially equal.

32. The liquid desiccant system of claim 29, wherein the heat exchanger comprises an evaporator coil within the supply airflow path configured to remove heat from the supply airflow, and the heat exchanger comprises a condenser coil within the regeneration airflow path configured to add heat to the regeneration airflow, and the heat removed from the supply airflow is added to the regeneration airflow.

33. The liquid desiccant system of claim 32, wherein a portion of the heat removed from the supply airflow is dissipated in a condenser unit not along the regeneration airflow path.

34. The liquid desiccant system of claim 29, wherein the regeneration airflow into the desorber unit has a regeneration mass airflow rate value and liquid desiccant flowing through the desorber unit has a desorber liquid desiccant mass flow rate value, and the regeneration mass airflow rate value is in a range from 40 to 80 times the desorber liquid desiccant mass flow rate value.

35. The liquid desiccant system of claim 29, wherein a concentration value of liquid desiccant in the desorber unit is 3% or greater, by weight, than a concentration value of the liquid desiccant in the absorber unit.

36. The liquid desiccant system of claim 29, wherein a concentration value of liquid desiccant in the desorber unit is 5% or greater, by weight, than a concentration value of the liquid desiccant in the absorber unit.

37. The liquid desiccant system of claim 29, wherein both the supply airflow and the regeneration airflow upstream the heat exchanger include unconditioned air.

38. A method of conditioning an airflow comprising:

circulating liquid desiccant through a liquid desiccant loop between an absorber unit and a desorber unit;

flowing supply air along a supply airflow path and through the absorber unit to form an absorber liquid/air interface within the absorber unit and a conditioned airflow exiting the absorber unit;

flowing regeneration air along a regeneration airflow path and through the desorber unit to form a desorber liquid/air interface within the desorber unit and an exhaust airflow exiting the desorber unit;

removing heat from the supply air upstream of the absorber unit; and while removing heat from the supply air stream, adding heat to the regeneration air upstream of the desorber unit;

wherein the liquid desiccant loop is devoid of (1) a liquid reservoir (2) a desiccant-to-liquid heat exchanger, and (3) a desiccant-to-refrigerant heat exchanger.

39. The method of claim 38, wherein at least 99% of total heat added to the liquid desiccant is added at the desorber liquid/air interface within the desorber unit.

40. The method of claim 38, wherein the liquid desiccant has a first temperature exiting the absorber unit and a second temperature entering the desorber unit and the first temperature and the second temperature are substantially equal.

41. The method of claim 38, wherein the heat removed from the supply air is added to the regeneration air.

42. The method of claim 38, wherein regeneration airflow into the desorber unit has a regeneration mass airflow rate value and liquid desiccant flowing through the desorber unit has a desorber liquid desiccant mass flow rate value, and the regeneration mass airflow rate value is in a range from 40 to 80 times the desorber liquid desiccant mass flow rate value.

43. The method of claim 38, wherein a concentration value of liquid desiccant in the desorber unit is 3% or greater, by weight, than a concentration value of the liquid desiccant in the absorber unit.

44. The method of claim 38, wherein a concentration value of liquid desiccant in the desorber unit is 5% or greater, by weight, than a concentration value of the liquid desiccant in the absorber unit.

45. The method of claim 38, wherein the circulating the liquid desiccant includes minimizing heat added to the liquid desiccant within the liquid desiccant loop outside the desorber liquid/air interface within the desorber unit.

46. A liquid desiccant system comprising:

a liquid desiccant loop in fluid communication with an absorber unit and a desorber unit such that liquid desiccant is flowable between the absorber unit and the desorber unit;

a supply airflow path passing through the absorber unit and forming an absorber liquid/air interface within the absorber unit and a conditioned airflow path exiting the absorber unit;

a regeneration airflow path passing through the desorber unit and forming a desorber liquid/air interface within the desorber unit and an exhaust airflow path exiting the desorber unit; and a heat exchanger thermally coupled to the supply airflow path and configured to remove heat from supply airflow along the supply airflow path upstream of the absorber unit, the heat exchanger thermally coupled to the regeneration airflow path and configured to add heat to regeneration airflow along the regeneration airflow path upstream of the desorber unit;

wherein at least 95% of total heat added to the liquid desiccant is added at the desorber liquid/air interface within the desorber unit; and wherein a portion of the regeneration airflow is removed from the regeneration airflow path between the heat exchanger and the desorber unit.

47. The liquid desiccant system of claim 46, wherein at least 99% of total heat added to the liquid desiccant is added at the desorber liquid/air interface within the desorber unit.

* * * * *